US008401432B2

(12) United States Patent
Hayashi et al.

(10) Patent No.: US 8,401,432 B2
(45) Date of Patent: Mar. 19, 2013

(54) DEVELOPING DEVICE AND IMAGE FORMING APPARATUS

(75) Inventors: Shigeki Hayashi, Osaka (JP); Takafumi Nagai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 266 days.

(21) Appl. No.: 12/939,019

(22) Filed: Nov. 3, 2010

(65) Prior Publication Data

US 2011/0103842 A1 May 5, 2011

(30) Foreign Application Priority Data

Nov. 4, 2009 (JP) ..... 2009-253099

(51) Int. Cl.
*G03G 15/08* (2006.01)

(52) U.S. Cl. ..... 399/253; 399/119

(58) Field of Classification Search ..... 399/119, 399/253

See application file for complete search history.

(56) References Cited

U.S. PATENT DOCUMENTS

| | | | | |
|---|---|---|---|---|
| 6,785,490 | B2 * | 8/2004 | Tsukamoto et al. | 399/94 |
| 2006/0086096 | A1 * | 4/2006 | Ghoshal | 62/3.2 |
| 2009/0269098 | A1 * | 10/2009 | Mori et al. | 399/94 |

FOREIGN PATENT DOCUMENTS

| | | |
|---|---|---|
| JP | 61-120176 | 6/1986 |
| JP | 1-219854 A | 9/1989 |
| JP | 6-147513 | 5/1994 |
| JP | 8-210748 | 8/1996 |
| JP | 2006-139045 A | 6/2006 |
| JP | 2006-317703 | 11/2006 |
| JP | 2009-36852 A | 2/2009 |

* cited by examiner

*Primary Examiner* — Walter L Lindsay, Jr.
*Assistant Examiner* — Benjamin Schmitt
(74) *Attorney, Agent, or Firm* — Birch, Stewart, Kolasch & Birch, LLP

(57) ABSTRACT

A developing device includes a developing tank for containing a powder developer, an agitating member disposed in the developing tank to agitate the powder developer; and a cooling tank attached to the developing tank. The cooling tank contains an endothermic material to absorb heat from the powder developer.

10 Claims, 6 Drawing Sheets

DEVELOPING DEVICE AND IMAGE FORMING APPARATUS

CROSS-REFERENCE TO RELATED APPLICATION

This application is related to Japanese patent application No. 2009-253099 filed on Nov. 4, 2009 whose priority is claimed under 35 USC §119, the disclosure of which is incorporated by reference in its entirety.

BACKGROUND OF THE INVENTION

1. Field of the Invention

The present invention relates to a developing device utilizing an electrophotographic method and an image forming apparatus.

2. Description of the Related Art

Generally, an image forming apparatus that utilizes an electrostatic photography method forms an image by charging, exposing, developing, transferring, cleaning, charge neutralizing, and fusing processes. For example, in the processes of forming an image, an electrostatic latent image is formed as a result of, uniformly charging a surface of a rotating drum type of photoconductor by a charging device, and irradiating the surface of the charged photoconductor with laser light by an exposure device.

Next, the electrostatic latent image on the photoconductor is developed by a developing device to form a toner image on the surface of the photoconductor. The toner image on the photoconductor is transferred onto a transfer material by a transfer device, and then, the toner image is fixed onto the transfer material as a result of pressure and heat being applied by a fusing device. The residual toner remaining on the surface of the photoconductor is removed by a cleaning device and collected in a collection section of the cleaning device. In addition, the residual charge is removed from the cleaned surface of the photoconductor by a neutralization device in order to prepare the next image formation.

Generally, a mono-component developer including only a toner, or a two-component developer including a toner and a carrier is used as a developer for developing the electrostatic latent image on the photoconductor. Since the carrier is not used in the mono-component developer, it is not necessary to have an agitating mechanism or the like in order to uniformly mix the toner and the carrier. Thus, the mono-component developer has the advantage of allowing the design of the developing device to be simplified. On the other hand, the mono-component developer has the disadvantage that it is difficult to stabilize the toner in electric change amount.

Since the two-component developer needs an agitating mechanism or the like for uniformly mixing the toner and the carrier, the two-component developer has the disadvantage of requiring a complicated design for the developing device. However, as a result of being superior in stabilizing the electric charge amount, the two-component developer is often used in a high-speed image forming apparatus or a color image forming apparatus.

In order to meet the demands of color printing, high-speed printing, and energy saving, there have been progressed in reduction of a particle size and a softening temperature of the toner used in the two-component developer. However, such a toner has the disadvantage of having a tendency to aggregate due to heat. Thus, if the temperature within the developing device rises due to frictional heat caused during agitation in the developing device, the temperature of the developer is increased. This leads to problems that the image is unevenly formed due to the aggregation of the developer and the reduction in fluidity of the developer.

Known methods that solve this problem include a method of cooling the developer by supplying air to the developing device, and or method of cooling the developer by installing a cooling element to the developing device (e.g., see Japanese Unexamined Patent Application No. HEI 01-219854).

However, the method of cooling the developer by supplying air has a problem where cooling capacity decreases when the surrounding temperature of the image forming apparatus is high. Furthermore, the method of cooling the developer by the cooling element has the following problems. The condensation occurs inside the developing device due to excessive cooling resulting from a high cooling capacity; and it is difficult to keep the temperature of the developing device constant even when the temperature control is conducted by a temperature detection sensor.

SUMMARY OF THE INVENTION

The present invention has been made in view of such situations, and provides a developing device and an image forming apparatus capable of preventing condensation even when the surrounding temperature of the image forming apparatus is high, and suppressing the aggregation of the developer and the reduction in fluidity of the developer by efficiently cooling the developer.

The present invention provides a developing device including: a developing tank that contains a powder developer; an agitating member which is disposed in the developing tank and which agitates the developer; and a cooling tank which is attached to the developing tank and which contains an endothermic material, wherein the endothermic material absorbs heat from the developer. The present invention also provides an image forming apparatus that uses the developing device.

With the present invention, overheating of the developer is suppressed and aggregation of the developer is prevented, since the endothermic material in the cooling tank attached to the developing tank absorbs the frictional heat of the developer.

DETAILED DESCRIPTION OF THE INVENTION

Figure 1:
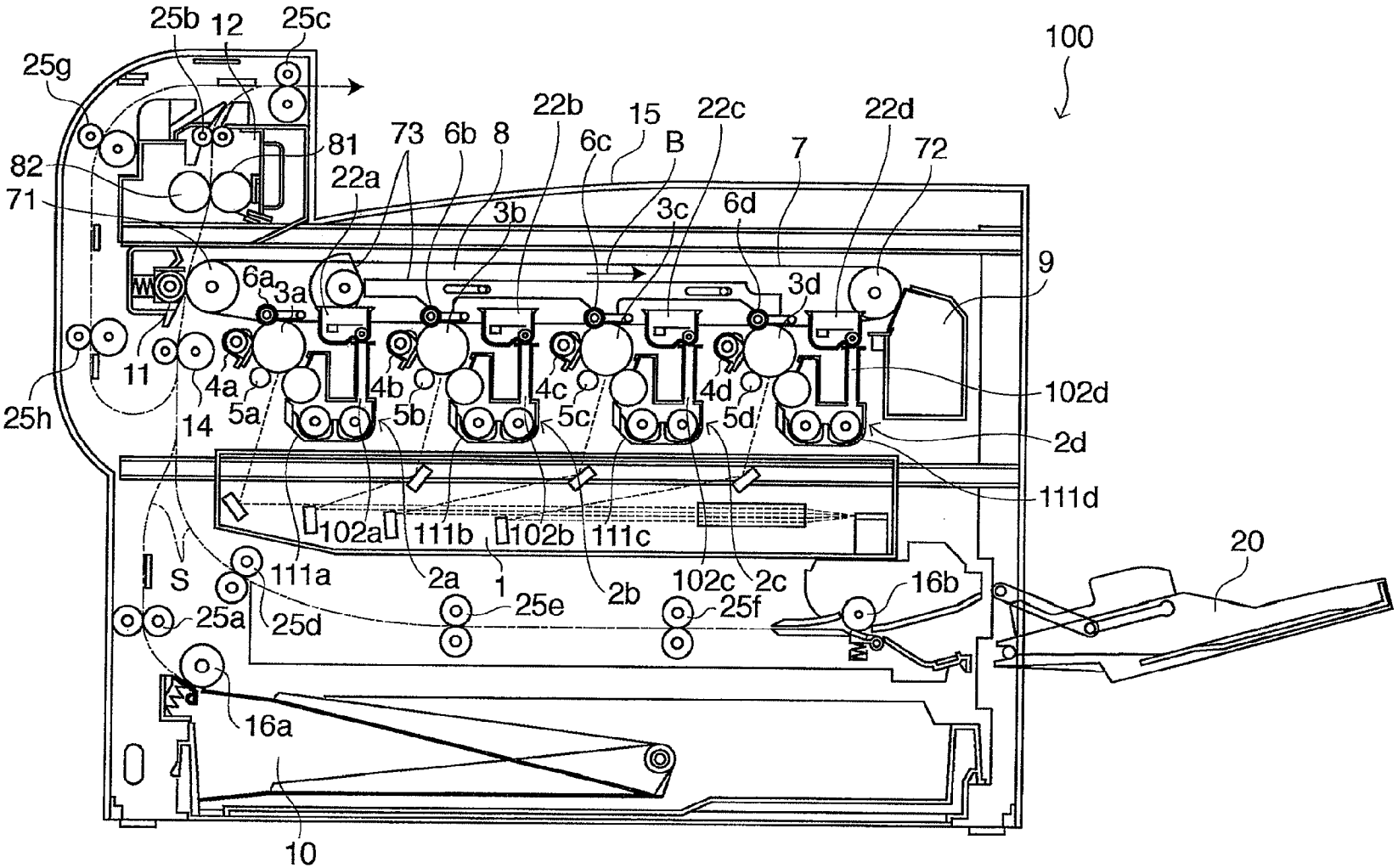
FIG. 1 is an illustrative diagram showing the whole configuration of an image forming apparatus in which a developing device according to an embodiment of the present invention is used.

A developing device of the present invention comprises: a developing tank that contains a powder developer; an agitating member which is disposed in the developing tank and which agitates the developer; and a cooling tank which is attached to the developing tank and which contains an endothermic material, wherein the endothermic material absorbs heat from the developer.

Furthermore, preferably, the endothermic material is an organic material or an inorganic material having a melting point of 30° C. or higher and 45° C. or lower.

In the case where such a material is used, even if agitating of the developer is intermittentingly conducted by the agitating member, overheating of the developer can be efficiently prevented, since the endothermic material can easily melt (transition to a liquid state) upon image formation operation (upon generation of heat by the developer), and since the endothermic material can easily crystallize (transition to a solid state) after an end of an image formation operation.

In addition, preferably, a wall surface of the cooling tank is formed from copper or aluminum having high thermal conductivity rates.

The heat of the developer is efficiently absorbed by the endothermic material since the cooling tank is formed from a material that has a high thermal conductivity rate. The cooling tank is preferably built inside the developing tank.

The cooling tank may include an electric cooling element that cools the endothermic material.

Preferably, a cooling duct that cools the electric cooling element is further included. Preferably, the cooling tank includes a hole which allows the cooling tank to be communicatively connected to the open air, and which also allows the endothermic material to be supplied through the hole and a volume change of the endothermic material to be absorbed.

In another aspect, the present invention provides an image forming apparatus including: a photoconductor drum having a surface where an electrostatic latent image is formed; a charging device that charges the surface of the photoconductor drum; an exposure device that forms an electrostatic latent image on the surface of the photoconductor drum; a developing device that supplies a toner to the electrostatic latent image on the surface of the photoconductor drum and forms a toner image; a transfer device that transfers the toner image from the surface of the photoconductor drum to a recording medium; and a fusing device that fuses the transferred toner image on the recording medium, wherein the developing device is a developing device that includes the developing tank, the agitating member, and the cooling tank. Preferably, when image formation is not conducted, the developing device prepares for the time when image formation is resumed, by supplying electricity to the electric cooling element and solidifying the endothermic material.

The present invention will be described in detail in the following by using an embodiment shown in the drawings.

FIG. 1 is an illustrative diagram showing the whole configuration of an image forming apparatus in which a developing device according to an embodiment of the present invention is used.

As shown in FIG. 1, an image forming apparatus 100 includes: photoconductor drums 3*a* to 3*d* having surfaces where electrostatic latent images are formed; chargers (charging devices) 5*a* to 5*d* that charge the surfaces of the photoconductor drums 3*a* to 3*d*; an exposure unit (exposure device) 1 that forms the electrostatic latent images on the surfaces of the photoconductor drums 3*a* to 3*d*; developing devices 2*a* to 2*d* that supply toners to the electrostatic latent images on the surfaces of the photoconductor drums 3*a* to 3*d* and form toner images; toner-supplying devices 22*a* to 22*d* that supply the toners to the developing devices 2*a* to 2*d*; an intermediate transfer belt unit (transfer device) 8 that transfers the toner images from the surfaces of the photoconductor drums 3*a* to 3*d* to a recording medium; and a fusing unit (fusing device) 12 that fuses a toner image on the recording medium.

The image forming apparatus 100 forms a multicolored or monochromatic image on a predefined sheet (recording paper, recording medium) in accordance with image data transmitted from an external source. A scanner or the like may be included in the upper portion of the image forming apparatus 100.

Next, the whole configuration and function of the image forming apparatus 100 will be described.

As shown in FIG. 1, the image forming apparatus 100 forms a color image by: processing image data representing each of color components of black (K), cyan (C), magenta (M), and yellow (Y); forming a black image, a cyan image, a magenta image, and a yellow image; and superimposing the images of each of the color components.

Thus, as shown in FIG. 1, in order to form images of each of the color components, the developing devices 2*a* to 2*d*, the photoconductor drums 3*a* to 3*d*, the chargers 5*a* to 5*d*, and cleaner units 4*a* to 4*d* are respectively provided in the image forming apparatus 100. In other words, one image formation station (image forming section) includes the developing device 2*a*, the photoconductor drum 3*a*, the charger 5*a*, and the cleaner unit 4*a*; and four of such image formation stations are provided in the image forming apparatus 100.

With regard to the characters of a to d described above, a represents members for black image formation, b represents members for cyan image formation, c represents members for magenta image formation, and d represents members for yellow image formation. Furthermore, other than the exposure unit 1 and the fusing unit 12, the image forming apparatus 100 also includes a sheet-conveying path S, a paper feed tray 10, and a paper output tray 15.

The chargers 5*a* to 5*d* uniformly charge the respective surfaces of the photoconductor drums 3*a* to 3*d* with a predefined electric potential.

Other than a contact roller type charger shown in FIG. 1, a contact brush type charger, a non-contact charger type charger, or the like may be used as the chargers 5*a* to 5*d*.

As shown in FIG. 1, the exposure unit 1 is a laser scanning unit (LSU) that includes a laser irradiating section and a reflective mirror. However, other than the laser scanning unit, an EL (electroluminescence) having light emitting elements arranged in an array, or an LED write head may be used as the exposure unit 1. By exposing the charged photoconductor drums 3*a* to 3*d* in accordance with inputted image data, the exposure unit 1 forms the electrostatic latent images respectively on the surfaces of the photoconductor drums 3*a* to 3*d* in accordance with the image data.

Each of the developing devices 2*a* to 2*d* brings out (develops) the electrostatic latent image formed on one of the photoconductor drums 3*a* to 3*d* by using either one of the toners of black (K), cyan (C), magenta (M), or yellow (Y). Toner transport mechanisms 102*a* to 102*d*, the toner-supplying devices 22*a* to 22*d*, and developing tanks 111*a* to 111*d* are disposed on respective upper portions of the developing devices 2*a* to 2*d*.

The toner-supplying devices 22*a* to 22*d* are respectively disposed at elevations higher than those of the developing tanks 111*a* to 111*d*, and store new toners (powdery toner) for supply. The toners are supplied from the toner-supplying devices 22*a* to 22*d* to the developing tanks 111*a* to 111*d* via the toner transport mechanisms 102*a* to 102*d*.

The cleaner units 4*a* to 4*d* remove and collect the toners remaining on the surfaces of the photoconductor drums 3*a* to 3*d* after development and after an image transfer process.

The intermediate transfer belt unit 8 is disposed at an elevation higher than the photoconductor drums 3*a* to 3*d*. The intermediate transfer belt unit 8 includes: intermediate transfer rollers 6*a* to 6*d*; an intermediate transfer belt 7; an intermediate transfer belt driving roller 71; an intermediate transfer belt driven roller 72; an intermediate transfer belt tension mechanism 73; and an intermediate transfer belt cleaning unit 9.

The intermediate transfer rollers 6*a* to 6*d*, the intermediate transfer belt driving roller 71, the intermediate transfer belt driven roller 72, and the intermediate transfer belt tension mechanism 73 extend the intermediate transfer belt 7, and allow the intermediate transfer belt 7 to be rotationally driven in an arrow B direction of FIG. 1.

The intermediate transfer rollers 6*a* to 6*d* are rotatably supported at intermediate transfer roller attaching parts of the intermediate transfer belt tension mechanism 73 in the intermediate transfer belt unit 8. A transfer bias is applied on the intermediate transfer rollers 6*a* to 6*d* in order to transfer toner images from the photoconductor drums 3*a* to 3*d* onto the intermediate transfer belt 7.

The intermediate transfer belt 7 is installed so as to make contact with each of the photoconductor drums 3*a* to 3*d*. A color toner image (multicolored toner image) is formed on the intermediate transfer belt 7 by sequentially transferring and overlaying the toner images which are formed on the photoconductor drums 3*a* to 3*d* and which include each of the color components. The intermediate transfer belt 7 is formed, for example, by using a film having a thickness of about 100 μm to 150 μm in an endless form.

The transfer of the toner images from the photoconductor drums 3*a* to 3*d* to the intermediate transfer belt 7 is conducted by the intermediate transfer rollers 6*a* to 6*d* contacting the back side of the intermediate transfer belt 7. A high voltage transfer bias (a high voltage having a reverse polarity (+) of a charge polarity (−) of the toner) is applied on the intermediate transfer rollers 6*a* to 6*d* in order to transfer the toner images.

Each of the intermediate transfer rollers 6*a* to 6*d* is formed by using a metal (e.g., stainless steel) shaft having a diameter of, for example, 8 to 10 mm as a base, and the surface is covered with an elastic material having conductivity (e.g., EPDM, urethane foam, and the like). The conductive elastic material allows the intermediate transfer rollers 6*a* to 6*d* to uniformly apply a high voltage on the intermediate transfer belt 7. Although a transfer electrode having a roller shape (intermediate transfer roller) is used in this embodiment, it is possible to use those having other shapes such as a brush and the like.

As described above, the electrostatic latent images on the photoconductor drums 3*a* to 3*d* are respectively brought out as toner images by the toners in accordance with respective color components. The toner images are layered as a result of being overlaid on the intermediate transfer belt 7. A layered toner image moves, by a rotation of the intermediate transfer belt 7, to a contact position (transfer part) between the intermediate transfer belt 7 and a paper that has been conveyed, and is transferred onto the paper by a transfer roller 11 disposed at this position.

Here, while the intermediate transfer belt 7 and the transfer roller 11 are being pressed against each other at a predefined nip, a voltage is applied to the transfer roller 11 in order to transfer the toner image to the paper. This voltage is a high voltage having a reverse polarity (+) of a charge polarity (−) of the toner.

In order to steadily obtain the nip, either one of the transfer roller 11 or the intermediate transfer belt driving roller 71 is formed from a hard material such as metal and the like, and the other is formed from a flexible material such as the case with an elastic roller (elastic rubber roller, formable resin roller) and the like.

The causes that generate a mixture of color toners in the next process lie in: toners adhered to the intermediate transfer belt 7 due to the contact between the intermediate transfer belt 7 and the photoconductor drums 3*a* to 3*d*; and toners which have not been transferred upon transfer of the toner image from the intermediate transfer belt 7 to the paper and which are remaining on the intermediate transfer belt 7. Such toners are removed and collected by the intermediate transfer belt cleaning unit 9 in order to prevent color mixing of toners.

The intermediate transfer belt cleaning unit 9 includes a cleaning blade (cleaning member) that makes contact with the intermediate transfer belt 7. A part where the intermediate transfer belt 7 is making contact with the cleaning blade is supported from the back side by the intermediate transfer belt driven roller 72.

The paper feed tray 10 is for storing sheets (e.g., recording paper) used for image formation, and is installed below the image forming section and the exposure unit 1. On the other hand, the paper output tray 15 installed at an upper section of the image forming apparatus 100 is for placing and holding printed sheets in a facedown manner.

Furthermore, the sheet-conveying path S is provided to the image forming apparatus 100 in order to guide a sheet from the paper feed tray 10 and a sheet from a manual feed tray 20 to the paper output tray 15 via the transfer part and the fusing unit 12. The transfer part is located between the intermediate transfer belt driving roller 71 and the transfer roller 11.

In addition, pickup rollers 16*a* and 16*b*, a resist roller 14, the transfer roller 11, the fusing unit 12, conveying rollers 25*a* to 25*h*, and the like are disposed along the sheet-conveying path S.

The conveying rollers 25*a* to 25*h* are multiple small rollers that facilitate and assist conveying of the sheets, and are installed along the sheet-conveying path S. The pickup roller 16*a* is installed at one end of the paper feed tray 10, and is a pull-in roller that feeds the sheet-conveying path S with a sheet from the paper feed tray 10, one sheet at a time.

The pickup roller 16*b* is installed in proximity to the manual feed tray 20, and is a pull-in roller that feeds the sheet-conveying path S with a sheet from the manual feed tray 20, one sheet at a time. The resist roller 14 temporarily holds the sheet conveyed by the sheet-conveying path S, and conveys the sheet to the transfer part at a timing that allows a front end of the toner image on the intermediate transfer belt 7 and a front end of the sheet to be aligned with each other.

The fusing unit 12 includes a heating roller 81, a pressure roller 82, and the like. The heating roller 81 and the pressure roller 82 pinch the sheet and rotate. The heating roller 81 is controlled by a control section (not shown) so as to be at a predefined fusing temperature. The control section controls the temperature of the heating roller 81 based on a detection signal from a temperature detector (not shown).

Together with the pressure roller 82, the heating roller 81 conducts a thermo compression bonding on the sheet to melt, mix, and apply pressure on the toner image which have been transferred to the sheet and which include each of the colors. As a result, the toner image is heat fused onto the sheet. The sheet that is fused with a multicolored toner image (toner image having each of the colors) is conveyed in a turnover paper outputting pathway of the sheet-conveying path S by the plurality of the conveying rollers, 25*a* to 25*h*, and is outputted onto the paper output tray 15 in a turned-over state (a state where the multicolored toner image is facing downward).

A sheet-conveying operation by the sheet-conveying path S will be described in the following.

As shown in FIG. 1 and as described above, the image forming apparatus 100 includes: the paper feed tray 10 for storing the sheets in advance; and the manual feed tray 20 used in cases such as when printing a small number of sheets, and the two trays respectively include pickup rollers 16*a* and 16*b* in order to allow a sheet to be fed to the sheet-conveying path S by the pickup rollers 16*a* and 16*b*, one sheet at a time.

When printing is conducted only on one side, the sheet conveyed from the paper feed tray 10 is conveyed to the resist roller 14 by the conveying roller 25*a* along the sheet-conveying path S, and is conveyed to the transfer part (the contact position between the transfer roller 11 and the intermediate transfer belt 7) by the resist roller 14 at the timing that allows the front end of the sheet and the front end of the layered toner image on the intermediate transfer belt 7 to be aligned with each other.

The toner image is transferred on the sheet at the transfer part, and the toner image is fused on the sheet by the fusing unit 12. Then, the sheet is outputted onto the paper output tray 15 from the paper outputting roller 25*c* via the conveying roller 25*b*.

Furthermore, the sheet conveyed from the manual feed tray 20 is conveyed to the resist roller 14 by conveying rollers 25*f*, 25*e*, and 25*d*. The rest of the sheet-conveying operation goes through the same process as that of the sheet fed from the paper feed tray 10, and the sheet is outputted to the paper output tray 15.

On the other hand, when printing is conducted on both sides of the sheet, the rear end of the sheet on which a one-side printing has been conducted and which has passed through the fusing unit 12 as described above, is fixed on the paper outputting roller 25*c*. Next, the sheet is led to the conveying rollers 25*g* and 25*h* due to a counter rotation of the paper outputting roller 25*c*, passes the resist roller 14 again, and is outputted to the paper output tray 15 after a back-side printing is conducted.

The configurations of the toner-supplying devices 22*a* to 22*d* of the present embodiment will be described more specifically in the following.

Figure 2:
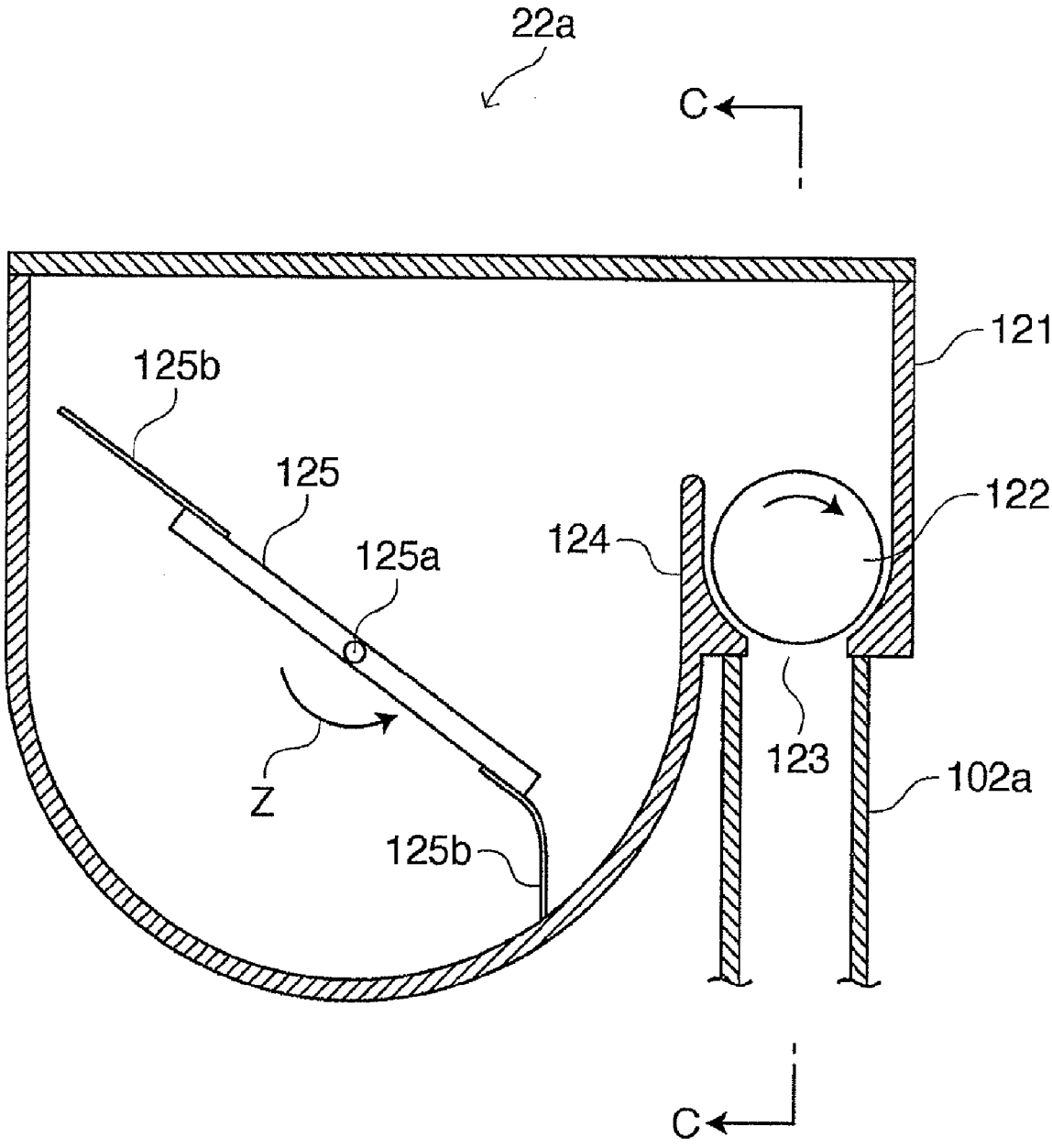
FIG. 2 is a cross sectional view of a toner-supplying device of the image forming apparatus shown in FIG. 1.
Figure 3:
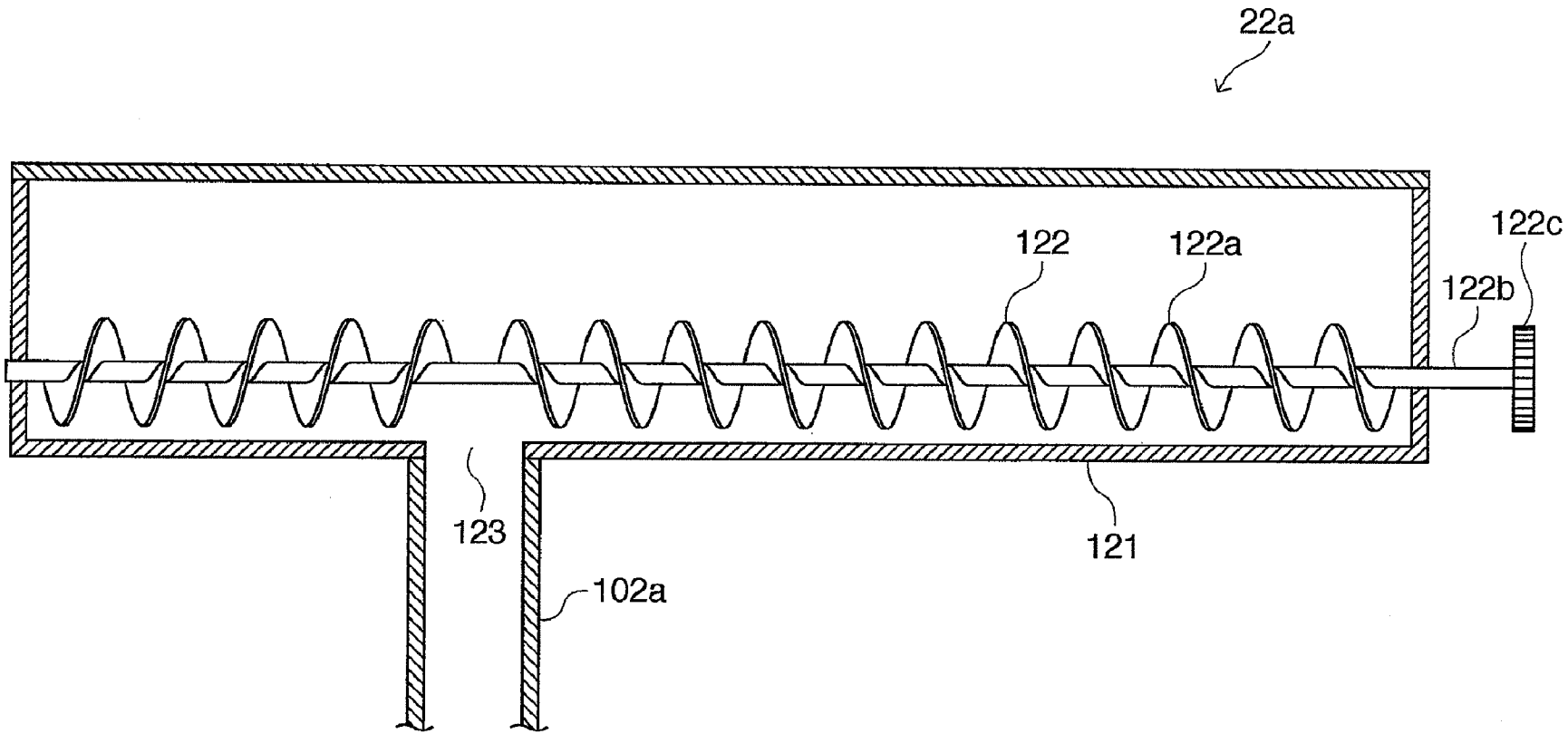
FIG. 3 is a cross sectional view as viewed from line C-C of FIG. 2.

FIG. 2 is a cross sectional view of a configuration of the toner-supplying device included in the image forming apparatus according to the present embodiment. FIG. 3 is a cross sectional view as viewed from line C-C of FIG. 2.

As shown in FIG. 2, the toner-supplying device 22*a* includes a toner container 121, a toner-agitating member 125, a toner-discharging member 122, and a toner outlet 123. The toner-supplying device 22*a* is disposed on the upper side of a developing tank 111*a*, and stores a new toner (powdery toner) for supply. Due to a rotation of the toner-discharging member (discharge screw) 122, the toner in the toner-supplying device 22*a* is supplied to the developing tank 111*a* via the toner outlet 123 and a toner transport mechanism 102*a*.

The toner container 121 which contains the toner is a nearly semicircle tube shaped container having an interior space, and rotatably supports the toner-agitating member 125 and the toner-discharging member 122. The toner outlet 123 is an approximately rectangle opening portion disposed below the toner-discharging member 122 but proximal to a central part of the toner-discharging member 122 in a shaft direction, and is disposed at a position adjacent to the toner transport mechanism 102*a*.

The toner-agitating member 125 is a plate-like member that, as a result of rotating with a rotational shaft 125*a* being a center of rotation, pumps up and conveys the toner in the toner container 121 to the toner-discharging member 122 while agitating the toner contained in the toner container 121. A toner-pumping member 125*b* is disposed at a front end of the toner-agitating member 125. The toner-pumping member 125*b* is a flexible polyethylene terephthalate (PET) sheet, and is attached on both ends of the toner-agitating member 125.

The toner-discharging member 122 supplies the toner in the toner container 121 to the developing tank 111*a* (FIG. 1) through the toner outlet 123, and includes: an auger screw including a toner-conveying blade 122*a* and a toner-discharging member rotational shaft 122*b*; and a toner-discharging member rotation gear 122*c*, as shown in FIG. 3. The toner-discharging member 122 is rotationally driven by a toner-discharging member driving motor that is not shown. The direction of the auger screw is configured such that the toner is conveyed toward the toner outlet 123 from both ends of the toner-discharging member 122 in the shaft direction.

As shown in FIG. 2, a toner-discharging member partition wall 124 is interposed between the toner-discharging member 122 and the toner-agitating member 125. As a result, an appropriate quantity of the toner pumped up by the toner-agitating member 125 can be held in the periphery of the toner-discharging member 122.

As shown in FIG. 2, the toner-agitating member 125 agitates the toner by rotating in the arrow Z direction, and pumps up the toner toward the toner-discharging member 122. At this moment, since being flexible, the toner-pumping member 125*b* deforms and slides along the inner wall of the toner container 121 during the rotation, and supplies the toner toward the toner-discharging member 122 side. Next, the supplied toner is led toward the toner outlet 123 due to the rotation of the toner-discharging member 122.

The toner-supplying devices 22*b* to 22*d* also have the configurations and functions similar to those of the toner-supplying device 22*a*.

The developing device 2*a* of the present embodiment will be described in the following with reference to FIG. 4 to FIG. 6.

Figure 4:
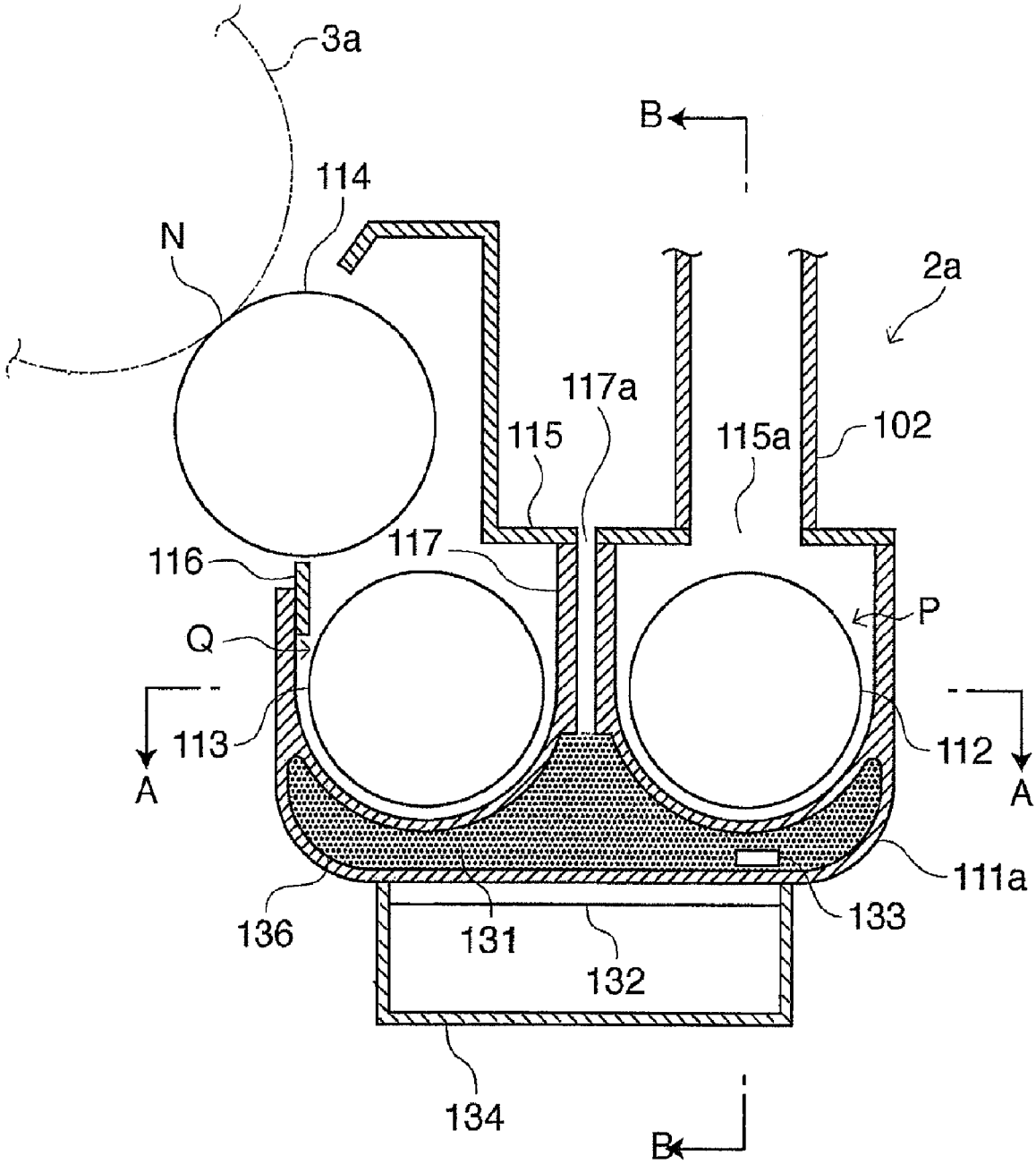
FIG. 4 is a cross sectional view of the developing device of the image forming apparatus shown in FIG. 1.

FIG. 4 is a cross sectional view showing a configuration of the developing device according to the present embodiment. FIG. 5 is a cross sectional view as viewed from line A-A of FIG. 4. FIG. 6 is a cross sectional view as viewed from line B-B of FIG. 4.

As shown in FIG. 4, the developing device 2*a* includes a developing roller 114 disposed in the developing tank 111*a* so as to face the photoconductor drum 3*a*. The developing device 2*a* is a device which supplies a toner to the surface of the photoconductor drum 3*a* by means of the developing roller 114, and which visualize (develops) an electrostatic latent image formed on the surface of the photoconductor drum 3*a*.

Figure 5:
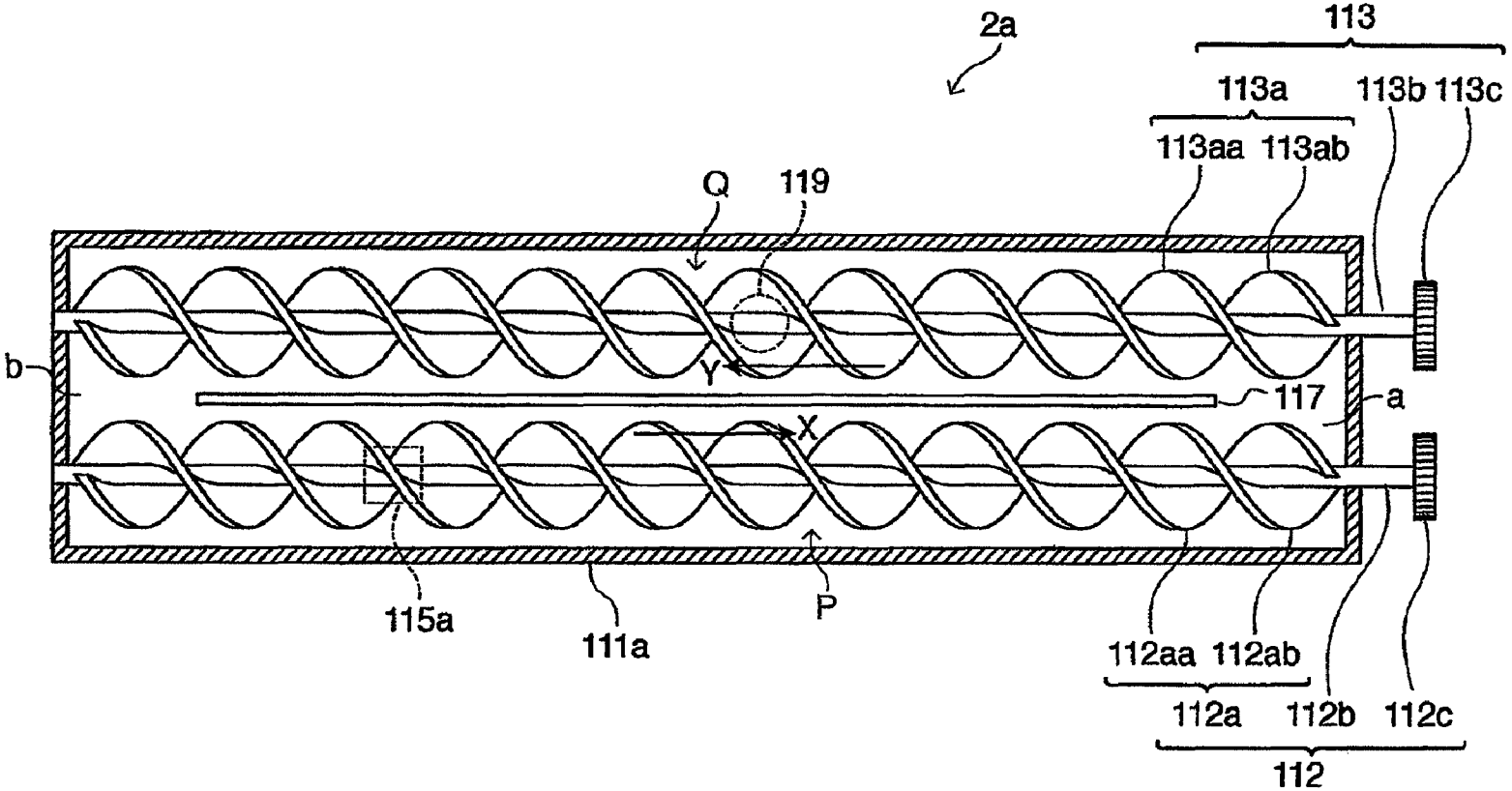
FIG. 5 is a cross sectional view as viewed from line A-A of FIG. 4.
Figure 6:
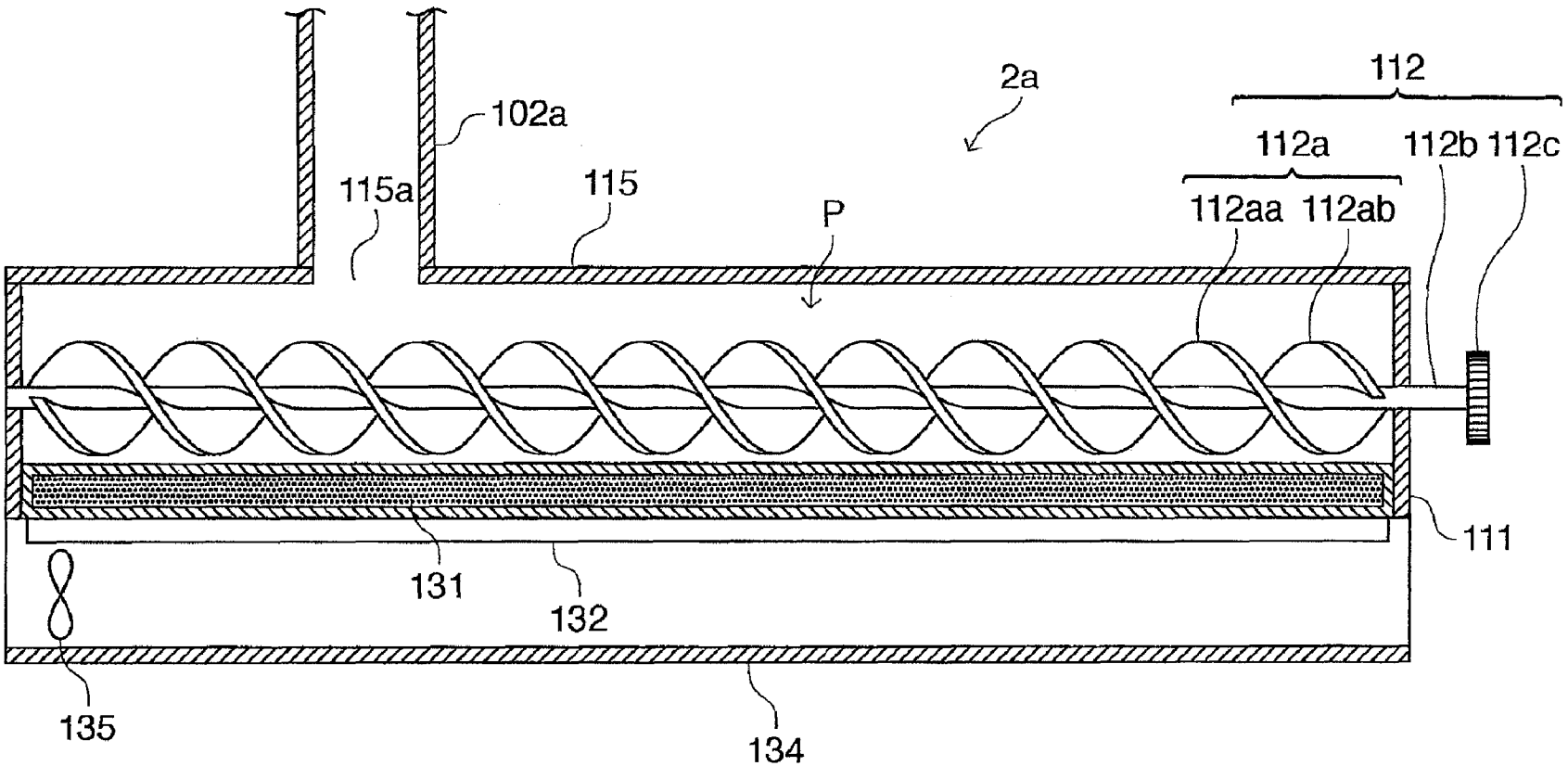
FIG. 6 is a cross sectional view as viewed from line B-B of FIG. 4.

Besides the developing roller 114 and the developing tank 111*a*, the developing device 2*a* includes a developing tank covering 115, a toner supply opening 115*a*, a doctor blade 116, a first agitating-conveying member 112, a second agitating-conveying member 113, a partition plate (partition wall) 117, and a toner concentration detection sensor (magnetic permeability sensor) 119 (FIG. 5).

The developing tank 111*a* is a tank that contains a two-component developer (hereinafter, simply referred to as a "developer") containing a carrier together with the toner. In addition, as described above, the developing tank 111*a* includes the developing roller 114, the first agitating-conveying member 112, the second agitating-conveying member 113, and the like. The carrier in the present embodiment is a magnetic carrier which has a magnetic property.

In the present embodiment, a cooling tank 136 is built in the bottom of the developing tank 111*a*, and the cooling tank 136 is filled with a endothermic material 131. In addition, a temperature sensor 133 that detects the temperature of the endothermic material 131 is disposed inside the cooling tank 136. Preferably, a metallic material, which has high thermal conductivity, such as copper, aluminum, a copper alloy or an aluminum alloy is used as a material of the cooling tank 136 and the developing tank 111*a*.

A Peltier element 132, which is an electric cooling element, is placed on the bottom surface of the developing tank 111*a* as a means for cooling the endothermic material 131. The endothermic material 131 is cooled by the Peltier element 132 that receives electric power from a power supply which is not shown. A cooling air duct 134 is disposed on the bottom surface of the developing tank 111*a* so as to cool a heat-generating surface of the Peltier element 132 with cooling air sent by a fan 135 (FIG. 6).

If the temperature detected by the temperature sensor 133 exceeds the melting point of the endothermic material 131, the power is supplied to the Peltier element 132 to solidify the endothermic material 131. Thus, the temperature of the endothermic material 131 can be prevented from greatly rising and exceeding the melting point.

In addition, when image formation is not conducted, preparations can be made for the time when image formation is resumed, by solidifying the entire endothermic material 131 as a result of supplying electricity to the Peltier element 132 and maintaining a temperature (e.g., 2° C. to 5° C.) that is lower than the melting point of the endothermic material 131.

In order to absorb a difference in volume of the endothermic material 131 between when melted and when solidified, a penetration hole 117*a* vertically penetrating the developing tank covering 115 and the partition plate 117 is formed as shown in FIG. 4. The penetration hole 117*a* allows the cooling tank 136 and the open air to be communicatively connected. The penetration hole 117*a* is also used to inject the endothermic material 131 to fill the cooling tank 136.

The endothermic material 131 prevents the developer from overheating by absorbing melting energy. Inorganic and organic materials which enter a solid state at around room temperature and which enter a liquid state at around a glass transition point of the toner can be used as the endothermic material 131. The inorganic and organic materials preferably have a melting point of 30° C. or higher 45° C. or lower, since it becomes difficult for a material to enter a solid state at around room temperature if the melting point is too low, and since cooling efficiency becomes low if the melting point is too high.

More specifically, the inorganic materials that can be used as the endothermic material 131 include: calcium chloride hexahydrate (melting point 30° C.), lithium nitrate trihydrate (melting point 30° C.), sodium sulfate decahydrate (melting point 32° C.), sodium carbonate decahydrate (melting point 33° C.), disodium hydrogen phosphate dodecahydrate (melting point 36° C.) and hexafluorophosphate (melting point 44° C.).

The organic materials that can be used as the endothermic material 131 include: ester compounds such as methyl palmitate (melting point 30° C.), methyl margarate (melting point 30° C.), amyl stearate (melting point 30° C.), diethyl 1,13-tridecanedicarboxylate (melting point 30° C.), propyl stearate (melting point 31° C.), tetradecyl myristate (melting point 32° C.), octyl stearate (melting point 32° C.), tetradecyl laurate (melting point 33° C.), dodecyl myristate (melting point 35° C.), octadecyl laurate (melting point 37° C.), methyl stearate (melting point 38° C.), tetradecyl myristate (melting point 39° C.), dodecyl palmitate (melting point 41° C.) and methyl arachidate (melting point 45° C.); alcoholates such as α-terpineol (melting point 36° C.), 1-tetradecanol (melting point 38° C.) and myristyl alcohol (melting point 38° C.); phenol compounds such as phenol (melting point 41° C.); aliphatic compounds such as n-nonadecane (melting point 32° C.), n-eicosane (melting point 37° C.) and docosane (melting point 44° C.); nitrogen-containing aromatic compounds such as N-octyl-4-methylpyridinium (melting point 44° C.) and N-hexylpyridinium (melting point 45° C.); siloxane compounds such as stearyl methylpolysiloxane (melting point 32° C.); and the like.

In particular, in terms of less dermal irritancy and environmental safety, higher alcoholates such as 1-tetradecanol (melting point 38° C.) and myristyl alcohol (melting point 38° C.), and ester compounds such as dodecyl palmitate (melting point 41° C.) and methyl arachidate (melting point 45° C.) are preferable.

The developing roller 114 is a magnet roller that is rotationally driven around a center shaft by a driving means which is not shown. The developing roller 114 carries up the developer in the developing tank 111*a*, holds the developer on its surface, and provides the photoconductor drum 3*a* with the toner included in the developer held on the surface.

Furthermore, the developing roller 114 is installed in the developing tank 111*a* so as to face the photoconductor drum 3*a*, but to be separated from the photoconductor drum 3*a* by having a gap therebetween. The developer conveyed by the developing roller 114 makes contact with the photoconductor drum 3*a* at the most proximal part. This contact area is a development nip part N. At the development nip part N, a development bias voltage is applied on the developing roller 114 by a power supply (not shown) connected to the developing roller 114, and the toner is supplied to the electrostatic latent image on the surface of the photoconductor drum 3*a* from the developer on the surface of the developing roller 114.

The doctor blade 116 positioned in proximity of the surface of the developing roller 114 is a rectangular plate-like member that extends parallel to the developing roller 114 in the shaft direction. One end of the doctor blade 116 in the short side direction is supported by the developing tank 111*a*, and the doctor blade 116 is installed such that a gap exists between a front end of the doctor blade 116 and the surface of the developing roller 114. Although stainless steel can be used as the material for the doctor blade 116, aluminum, a synthetic resin, and the like can also be used.

As shown in FIG. 5, the first agitating-conveying member 112 includes: a helical auger screw including a helical first conveying blade (helical blade) 112*a* and a first rotational shaft 112*b*; and a first conveying gear 112*c*. The first agitating-conveying member 112 agitates and conveys the developer, by being rotationally driven by a driving means (not shown) such as a motor.

The first conveying blade 112*a* is a double helix blade having a double helix structure, and includes a first(A) helical blade 112*aa* and a first(B) helical blade 112*ab*.

The first(A) helical blade 112*aa* and the first(B) helical blade 112*ab* have identical helical pitches. In addition, a phase difference between the first(A) helical blade 112*aa* and the first(B) helical blade 112*ab* is 180 degrees. Assumed next is a case where the first agitating-conveying member 112 is viewed in the shaft direction of the first rotational shaft 112*b* from the upstream of the developer conveyance direction. If the first(A) helical blade 112*aa* alone is to be rotated clockwise, the first(A) helical blade 112*aa* and the first(B) helical blade 112*ab* overlap at a certain angle of the rotation. The above-described phase difference refers to this angle of rotation at which the two blades overlap.

As shown in FIG. 5, the second agitating-conveying member 113 includes: a helical auger screw including a helical second conveying blade (helical blade) 113*a* and a second rotational shaft 113*b*; and a second conveying gear 113*c*. The second agitating-conveying member 113 agitates and conveys the developer, by being rotationally driven by a driving means (not shown) such as a motor.

The second conveying blade 113*a* is a double helix blade having a double helix structure, and includes a second(A) helical blade 113*aa* and a second(B) helical blade 113*ab*.

The second(A) helical blade 113*aa* and the second(B) helical blade 113*ab* have identical helical pitches. In addition, a phase difference between the second(A) helical blade 113*aa* and the second(B) helical blade 113*ab* is 180 degrees.

The toner concentration detection sensor 119 is installed at a part which is approximately in the center in the developer conveyance direction and which is on the bottom surface of the developing tank 111*a* vertically below the second agitating-conveying member 113. The toner concentration detection sensor 119 is installed such that the surface of the sensor is exposed inside the developing tank 111*a*. The toner concentration detection sensor 119 is electrically connected to a toner concentration control means which is not shown. Depending on a toner concentration measurement value detected by the toner concentration detection sensor 119, the toner concentration control means controls and rotationally drives the toner-discharging member 122 to supply the toner to the inside of the developing tank 111*a* via the toner outlet 123, as shown in FIG. 3.

If it is determined that the toner concentration measurement value detected by the toner concentration detection sensor 119 is lower than a toner concentration setting value, a control signal is transmitted to the driving means that rotationally drives the toner-discharging member 122, and the toner-discharging member 122 is rotationally driven. A general toner concentration detection sensor including, for example, a transmitted-light detection sensor, a reflected light detection sensor, a magnetic-permeability detection sensor, and the like can be used as the toner concentration detection sensor 119. Among these, the magnetic-permeability detection sensor is preferable.

A power supply (not shown) is connected to the magnetic-permeability detection sensor. The power supply applies, on the magnetic-permeability detection sensor, a driving voltage to drive the magnetic-permeability detection sensor, and a control voltage in order to output a detection result of the toner concentration to the control means. The application of voltage on the magnetic-permeability detection sensor by the power supply is controlled by the control means.

The magnetic-permeability detection sensor is a type of sensor that outputs the detection result of the toner concentration as an output voltage value when a control voltage is applied. Since the magnetic-permeability detection sensor basically has a fine sensitivity around a median of the output voltage, a control voltage that allows obtaining of an output voltage in the vicinity of the median is applied to the magnetic-permeability detection sensor. Such type of magnetic-permeability detection sensors are commercially available, including, for example, TS-L, TS-A, TS-K (all of which are product names and are manufactured by TDK Corp.), and the like.

As shown in FIG. 4, the developing tank covering 115, which is removable, is installed on the upper side of the developing tank 111*a*. Furthermore, the toner supply opening 115*a* is formed on the developing tank covering 115, in order to supply the new toner to the inside of the developing tank 111*a*.

Thus, as shown in FIG. 1, the toner contained in the toner-supplying device 22*a* is supplied to the developing tank 111*a*, by having the toner transported to the inside of the developing tank 111*a* via the toner transport mechanism 102*a* and the toner supply opening 115*a*.

In the developing tank 111*a*, the partition plate 117 is interposed between the first agitating-conveying member 112 and the second agitating-conveying member 113. The partition plate 117 is installed such that it extends parallel to the first agitating-conveying member 112 and the second agitating-conveying member 113 in both shaft directions (both rotational shaft directions). As shown in FIG. 5, the inside of the developing tank 111*a* is partitioned by the partition plate 117 into a first conveying path P in which the first agitating-conveying member 112 is disposed, and a second conveying path Q in which the second agitating-conveying member 113 is disposed.

There is a distance between the partition plate 117 and the internal wall surface of the developing tank 111*a*, at both ends, in respective shaft directions of the first agitating-conveying member 112 and the second agitating-conveying member 113. As a result, communicating paths that communicatively connect the first conveying path P and the second conveying path Q are formed in the developing tank 111*a* at the vicinity of both ends of the first agitating-conveying member 112 and the second agitating-conveying member 113 in both of the shaft directions.

Hereinafter, as shown in FIG. 5, a communicating path formed in the vicinity of the end in the arrow X direction is referred to as a first communicating path a, and a communicating path formed in the vicinity of the end in the arrow Y direction is referred to as a second communicating path b.

The first agitating-conveying member 112 and the second agitating-conveying member 113 are arranged such that: circumferential surfaces of both agitating-conveying members face each other having the partition plate 117 in between; and the shafts of both agitating-conveying members are parallel to each other. Furthermore, both agitating-conveying members are configured such that each of the agitating-conveying members rotates in a direction opposite of the other.

As shown in FIG. 5, the first agitating-conveying member 112 is configured so as to convey the developer in the arrow X direction, and the second agitating-conveying member 113 is configured so as to convey the developer in the arrow Y direction which is opposite of the arrow X direction.

The toner supply opening 115*a* is formed along the first conveying path P, and at a position toward the arrow X direction side from the second communicating path b. Thus, the toner is supplied downstream from the second communicating path b along the first conveying path P.

In the developing tank 111*a*, the first agitating-conveying member 112 and the second agitating-conveying member 113 are rotationally driven by a driving means (not shown) such as a motor to convey the developer.

More specifically, the developer is conveyed to the arrow X direction along the first conveying path P while being agitated by the first agitating-conveying member 112, and reaches the first communicating path a. The developer that has reached the first communicating path a passes through the first communicating path a, and is conveyed to the second conveying path Q.

On the other hand, the developer is conveyed to the arrow Y direction along the second conveying path Q while being agitated by the second agitating-conveying member 113, and reaches the second communicating path b. Then, the developer that has reached the second communicating path b passes through the second communicating path b, and is conveyed to the first conveying path P.

Thus, the first agitating-conveying member 112 and the second agitating-conveying member 113 convey the developer in directions that are opposite to each other while agitating the developer.

In the manner described above, the developer circulates within the developing tank 111*a* along the first conveying path P, the first communicating path a, the second conveying path Q, and the second communicating path b, in a sequence of the first conveying path P→the first communicating path a→the second conveying path Q→the second communicating path b. As the developer is conveyed along the second conveying path Q, the developing roller 114 rotates to hold and pump up the developer on the surface of the developing roller 114. Then, the toner in the developer that has been pumped up moves to the photoconductor drum 3*a*, resulting in a progressive consumption of the toner.

In order to supplement the consumed toner, a new toner is supplied to the first conveying path P from the toner supply opening 115*a*. The supplied toner is mixed and agitated with the developer that pre-exists in the first conveying path P.

The developing devices 2*b* to 2*d* also have configurations and functions similar to those of the developing device 2*a*.

What is claimed is:

1. A developing device comprising:

a developing tank for containing a powder developer;

an agitating member disposed in the developing tank to agitate the powder developer; and a cooling tank attached to the developing tank, the cooling tank containing an endothermic material that absorbs heat from the powder developer, wherein the cooling tank includes a hole which allows the cooling tank to be communicatively connected to an open air, and which also allows the endothermic material to be supplied through the hole and a volume change of the endothermic material to be absorbed.

2. The developing device of claim 1, wherein the endothermic material is an organic or inorganic material having a melting point of 30° C. or higher and 45° C. or lower.

3. The developing device of claim 1, wherein the cooling tank is made of copper, aluminum, a copper alloy or an aluminum alloy.

4. The developing device of claim 1, wherein the cooling tank is built in the developing tank.

5. The developing device of claim 1, wherein the cooling tank includes an electric cooling element for cooling the endothermic material.

6. The developing device of claim 5, further comprising:

a cooling duct for cooling the electric cooling element.

7. An image forming apparatus comprising:

a photoconductor drum;

a charging device for charging a surface of the photoconductor drum;

an exposure device for forming an electrostatic latent image on the surface of the photoconductor drum;

a transfer device for transferring the toner image from the surface of the photoconductor drum to a recording medium; and a fusing device for fusing the transferred toner image on the recording medium; and the developing device of claim 1, for supplying a toner to the electrostatic latent image to form a toner image.

8. The image forming apparatus of claim 7, wherein the cooling tank includes an electric cooling element for cooling the endothermic material, and the electric cooling element receives electric power to solidify the endothermic material when image formation is not conducted.

9. A developing device comprising:

a developing tank for containing a powder developer;

an agitating member disposed in the developing tank to agitate the powder developer; and a cooling tank attached to the developing tank, the cooling tank containing an endothermic material that absorbs heat from the powder developer, wherein the endothermic material is an organic material selected from ester compounds, alcoholates, aliphatic compounds, nitrogen-containing aromatic compounds, phenol compounds and siloxane compounds.

10. A developing device comprising:

a developing tank for containing a powder developer;

an agitating member disposed in the developing tank to agitate the powder developer; and a cooling tank attached to the developing tank, the cooling tank containing an endothermic material that absorbs heat from the powder developer, wherein the endothermic material is selected from 1-tetradecanol, myristyl alcohol, dodecyl palmitate and methyl arachidate.

* * * * *